US006499173B2

(12) United States Patent
Van Ornum

(10) Patent No.: US 6,499,173 B2
(45) Date of Patent: Dec. 31, 2002

(54) CULVERT CLEANING APPARATUS

(76) Inventor: Leslie Van Ornum, P.O. Box 446, Hortonville, WI (US) 54944

( * ) Notice: Subject to any disclaimer, the term of this patent is extended or adjusted under 35 U.S.C. 154(b) by 89 days.

(21) Appl. No.: 09/730,887

(22) Filed: Dec. 7, 2000

(65) Prior Publication Data

US 2002/0069471 A1 Jun. 13, 2002

(51) Int. Cl.[7] ..... B08B 9/047
(52) U.S. Cl. ..... 15/104.095; 15/88; 15/104.31
(58) Field of Search ..... 15/88, 104.03, 15/104.05, 104.09, 104.095, 104.31

(56) References Cited

U.S. PATENT DOCUMENTS

| | | | | | |
|---|---|---|---|---|---|
| 473,821 | A | * | 4/1892 | Carbis | 15/104.095 |
| 582,953 | A | * | 5/1897 | Robeson et al. | 15/104.05 |
| 690,878 | A | * | 1/1902 | Roan | 15/104.095 |
| 1,376,995 | A | | 5/1921 | Balsley | 15/104.31 |
| 1,932,068 | A | * | 10/1933 | Englebright et al. | 15/104.09 X |
| 2,675,570 | A | | 4/1954 | Sacks | 15/104.095 |
| 2,792,807 | A | * | 5/1957 | Cummings | 15/104.09 X |
| 2,967,316 | A | * | 1/1961 | Kandle | 15/104.095 |
| 3,022,908 | A | * | 2/1962 | Arnold | 15/104.31 X |
| 3,987,511 | A | * | 10/1976 | Mayer et al. | 15/88 X |
| 4,015,304 | A | * | 4/1977 | Dillinger | 15/104.095 |
| 4,095,305 | A | * | 6/1978 | Goodwin | 15/104.095 |
| 4,137,928 | A | * | 2/1979 | Sentell | 15/104.095 X |
| 4,369,071 | A | * | 1/1983 | Flach et al. | 15/104.09 X |
| 5,417,169 | A | * | 5/1995 | Carpenter et al. | 15/104.05 X |
| 5,813,089 | A | | 9/1998 | Nolan et al. | 15/383 |
| 5,940,920 | A | | 8/1999 | Hare et al. | 15/88 |

FOREIGN PATENT DOCUMENTS

| | | | | |
|---|---|---|---|---|
| DE | 128044 | * | 2/1902 | 15/104.095 |
| EP | 338143 | * | 10/1989 | 15/104.05 |
| GB | 682455 | * | 11/1952 | 15/104.095 |
| SU | 464345 | * | 3/1975 | 15/104.095 |

* cited by examiner

*Primary Examiner*—Mark Spisich
(74) *Attorney, Agent, or Firm*—Russell L. Johnson

(57) ABSTRACT

An apparatus for cleaning culverts and the like, and the apparatus has a longitudinal beam having a first end and a second end, adjustable support legs secured to said first and second ends of the beam, a carriage movably mounted on the beam between the support legs, apparatus for moving the carriage along the beam, a motor having a rotatable shaft secured to the carriage beneath the beam, and the rotatable shaft is configured to receive a removable coupling, at least one drive link having a first end and a second end and the first and second ends are configured to receive removable couplings and the drive link is joined to the rotatable shaft by a removable coupling and a culvert cleaning tool having a shaft configured to receive a removable coupling and the shaft is secured to the drive link by a removable coupling. The apparatus is provided with couplings for attaching and detaching the apparatus to and from a carrier vehicle. The carrier vehicle serves to transport and position the apparatus. The support vehicle also provides power to the apparatus.

9 Claims, 3 Drawing Sheets

CULVERT CLEANING APPARATUS

BACKGROUND OF THE INVENTION

1. Field of the Invention

This invention relates to an apparatus for opening clogs and removing accumulations of debris from culverts.

More particularly this invention relates to an apparatus which guides a cleaning tool into and/or through culverts and/or culvert-like pipes.

Still more particularly, this invention relates to the apparatus described above wherein the apparatus is supplied power and transport from a conventional materials handling vehicle.

Culverts come in many sizes and shapes and constructions. They are typically used to provide a passage for surface water from one side of an obstruction in a water course to the other. They are frequently a part of a surface ditching system and therefore are found in association with unlevel terrain which is often overgrown with vegetation and filled with debris of all kinds. When debris accumulates in a culvert it provides a damming effect that allows water to pool and stagnate. These pools become a breeding ground for mosquitoes and an agent for the odoriferous decomposition of organic materials carried into the culvert during a period of water flow. In regions where the temperatures fall below freezing, culverts can accumulate ice and snow and become plugged so as to block the flow of water.

Because of the varieties of sizes and shapes of culverts and the assortments of accumulations that can occur in culverts and the difficulties presented in access to culverts, those responsible for the cleaning and clearing of culverts have heretofore found situational solutions to their situational problems.

It is an object of this invention to provide a general application apparatus for clearing and cleaning culverts.

2. Description of the Related Art

The patent art abounds with cleaners for underground pipes and tubes.

U.S. Pat. No. 1,376,995 to Balsley teaches a hinged hoe blade on a handle and handle extensions for manually scraping dirt and debris from culverts.

U.S. Pat. No. 5,813,089 to Nolan et al teaches a rotating brush driven by a flexible cable powered by a remote motor and a means for introducing flushing fluids into the vicinity of the brush.

U.S. Pat. No. 2,675.570 to Sacks teaches a a rotating cutting tool having shaft extensions for removing deposits in the interior of pipes and conduits.

U.S. Pat. No. 5,940,920 to Hare et al teaches a brush mounted on a rotating rigid rod which is translated into and out of a pipe by movement of a head mounted on a frame.

BRIEF SUMMARY OF THE INVENTION

The invention is for an apparatus for cleaning culverts and the like, comprising; a longitudinal beam having a first end and a second end, support legs secured to said first and second ends of the beam, a carriage movably mounted on the beam between the support legs, a means for moving the carriage along the beam, a motor having a rotatable shaft secured to the carriage beneath the beam, and the rotatable shaft configured to receive a removable coupling, at least one drive link having a first end and a second end and the first and second ends are configured to receive removable couplings and the drive link is joined to the rotatable shaft by means of a removable coupling and a culvert cleaning tool having a shaft configured to receive a removable coupling and the shaft is secured to the drive link by means of a removable coupling.

The apparatus is provided with a means for attaching and detaching the apparatus to and from a carrier vehicle. The carrier vehicle serves to transport and position the apparatus. The support vehicle also provides power to the apparatus.

DETAILED DESCRIPTION OF THE INVENTION

Figure 1:
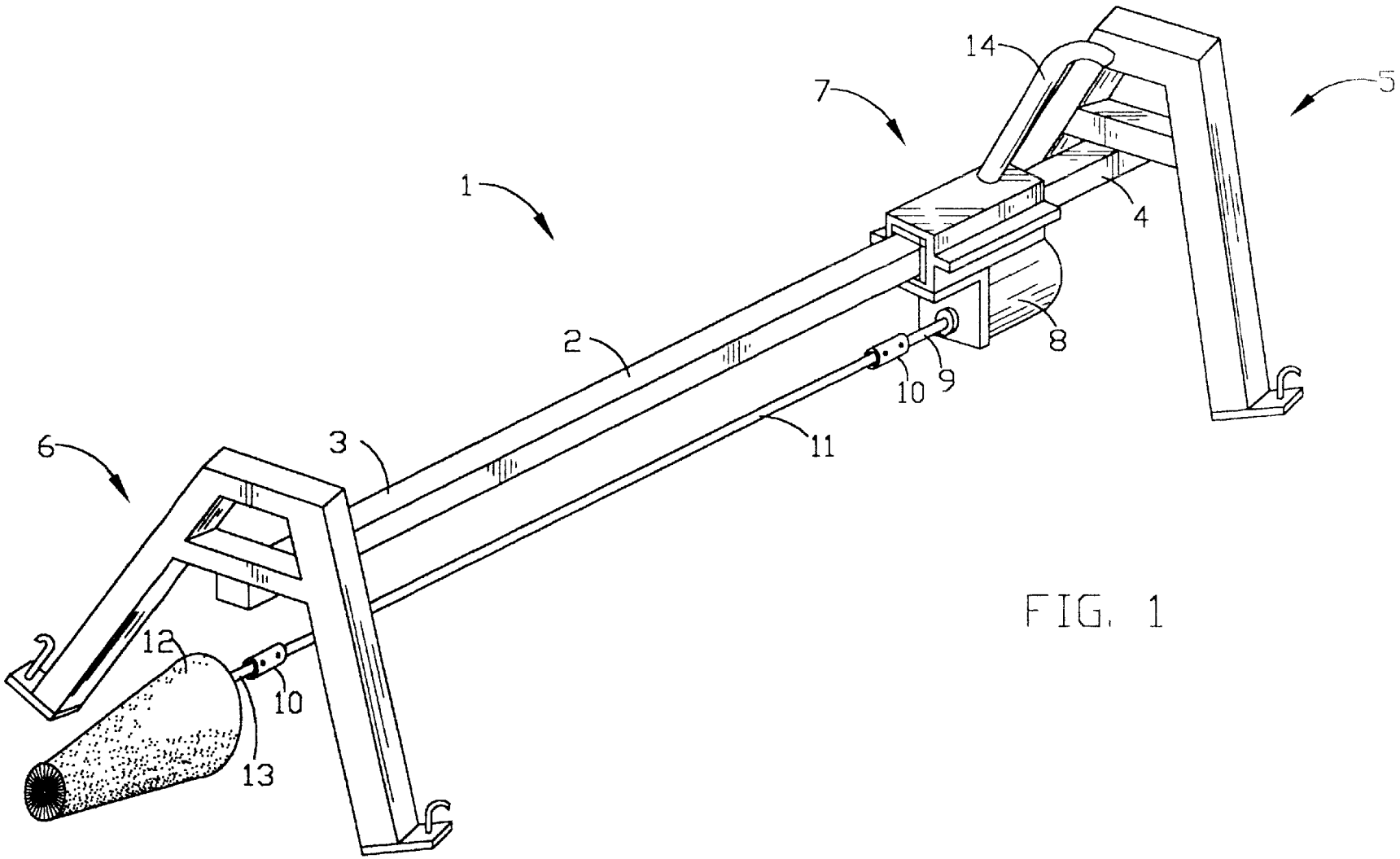
FIG. 1 is a pictorial view of the apparatus of this invention.

In the drawings like numbers refer to like objects and proportions of some components have been modified to facilitate illustration. The term "culvert" as used herein shall be read to mean "a culvert, pipe or tube".

Referring now to FIG. 1 wherein the apparatus of this invention is shown in its simplest form, Beam 2 has transverse leg assemblies 5 and 6 secured near its first end 3 and it second end 4. Carriage 7 is slidably mounted on beam 2. A motor 8 having a rotatable shaft 9 is secured to carriage 7 and depends therefrom. Rotatable shaft 9 is provided with coupling 10 by means of which drive link 11 may be joined to rotatable shaft 9 at one end of drive link 11. Drive link 11 is provided at its other end with a second coupling 10. A culvert clearing tool 12 having shaft 13 is engageable with second coupling 10 on drive link 11. Handle 14 serves as a means to move carriage 7 along beam 2 so as move culvert cleaning tool 12 into and out of a culvert.

The apparatus of FIG. 1 represents the invention in one of its simplest forms. To be effective as a general use culvert cleaner this invention must be versatile and adaptable. The following specifications will disclose the embodiments of the components of this invention that enable it to serve as a general use culvert cleaner.

In use, the beam 2 component of this invention shown in FIG. 1 as a box beam is positioned parallel to the long axis of a culvert. Beam 2 is positioned and supported by means of transverse leg assemblies 5 and 6.

Figure 2:
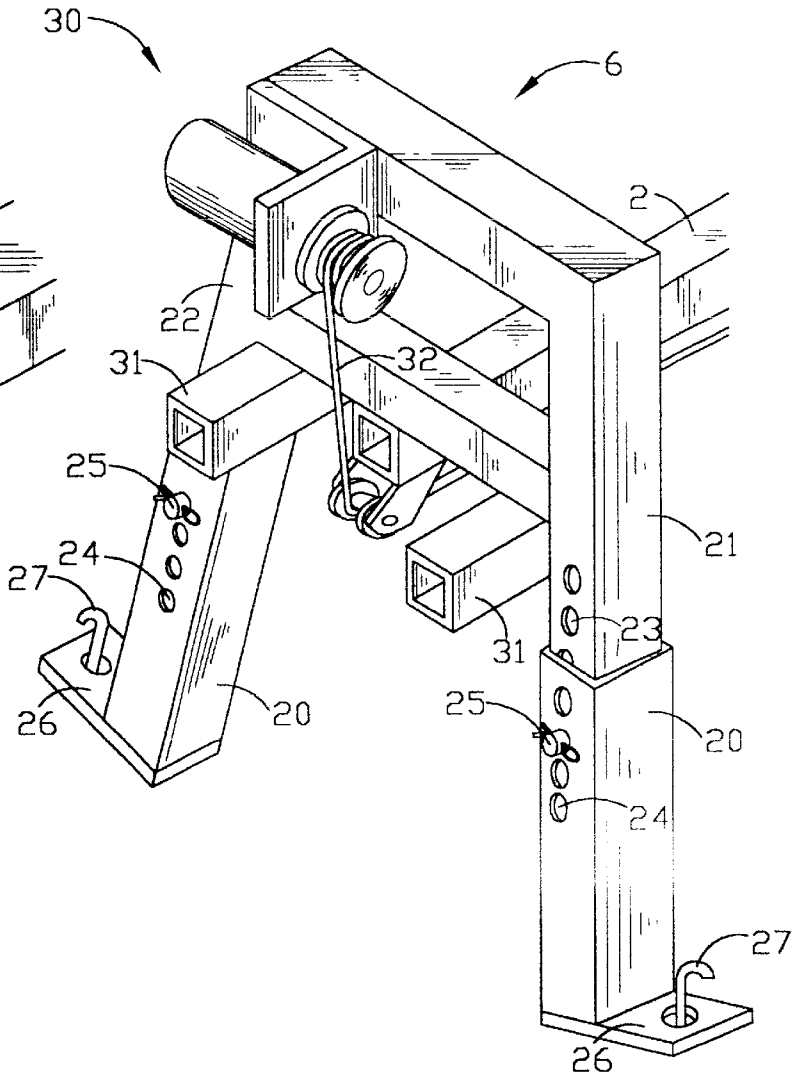
FIG. 2 is a pictorial view of the transverse leg assembly component of this invention.

The terrain near a culvert is normally sloped and ditched, transverse leg assemblies 5 and 6 are provided with adjustable legs 20 as shown in FIG. 2 to permit the positioning of beam 2 parallel to the longitudinal axis of a culvert.

As shown in FIG. 2, transverse leg assemblies 5 and 6 are shown to have an "A" configuration and legs 21 and 22 have holes 23 passing therethrough so as to be adjustably allignable with holes 24 in adjustable legs 20. Pins 25 serve to secure legs 20 in place along legs 21 and 22. Legs 20 are provided with feet 26 through which pins 27 may be passed to secure the engagement of feet 26 with the terrain.

Transverse leg assemblies 5 and 6 may also serve as a mounting base for components such as winch 30 and couplings 31. Winch 30 may serve to pay out and take up cable 32 as a power assist to moving carriage 7. Receivers 31 may serve to join apparatus 1 to a carrier vehicle.

Figure 3:
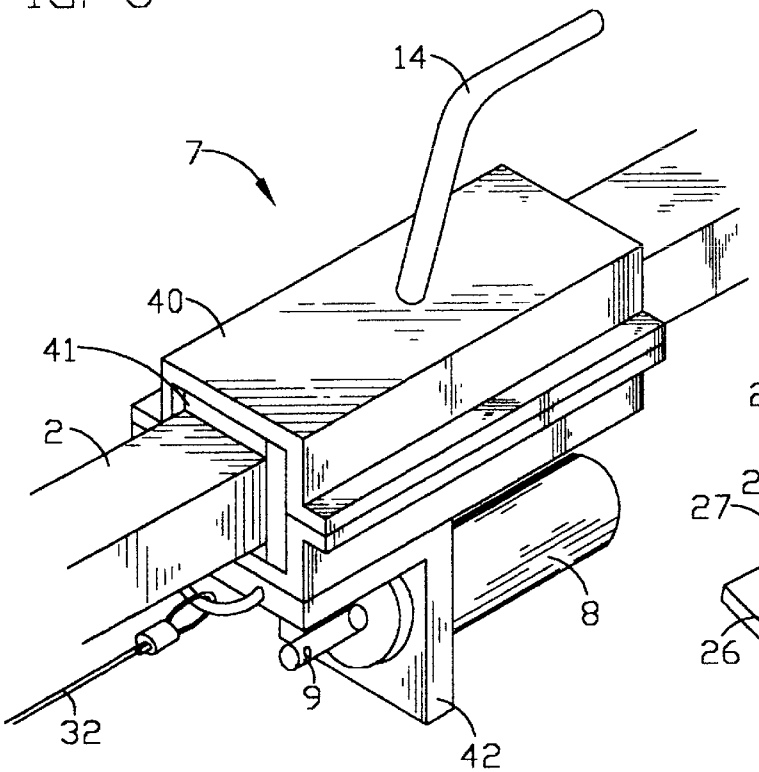
FIG. 3 is a pictorial view of the carriage component of this invention.

In FIG. 3 carriage 7 is shown to be slidably mounted on beam 2. Carriage 7 has housing 40 surrounding bearing 41 which surrounds beam 2. Bearing 41 is here shown to comprise plates of high density, high lubricity plastic secured to housing 40. In use, torque and thrust forces transmitted from the cleaning tool place diverse loads on bearing 41 as it is translated along beam 2. The large and circumferential surface area of bearing 41 distributes the forces transmitted to it while permitting free movement along beam 2.

Motor 8 is suspended beneath carriage 7 by means of bracket 42. Cable 32 from winch 30 is connected to bracket 42 so as to run parallel to beam 2. In this embodiment of the invention cable 32 serves to pull carriage 7 towards transverse leg assembly 6 and handle 14 serves as a means for returning carriage 7 to its starting position shown in FIG. 1.

The underlying concept of the invention is embodied in the components illustrated in FIGS. 1 through 3. A major virtue of this invention is that it is adaptable to deal with situational circumstances. In pursuit of that objective, the invention has been conceived of to be reconfigured and adapted to the circumstances in which it will function.

Figure 4:
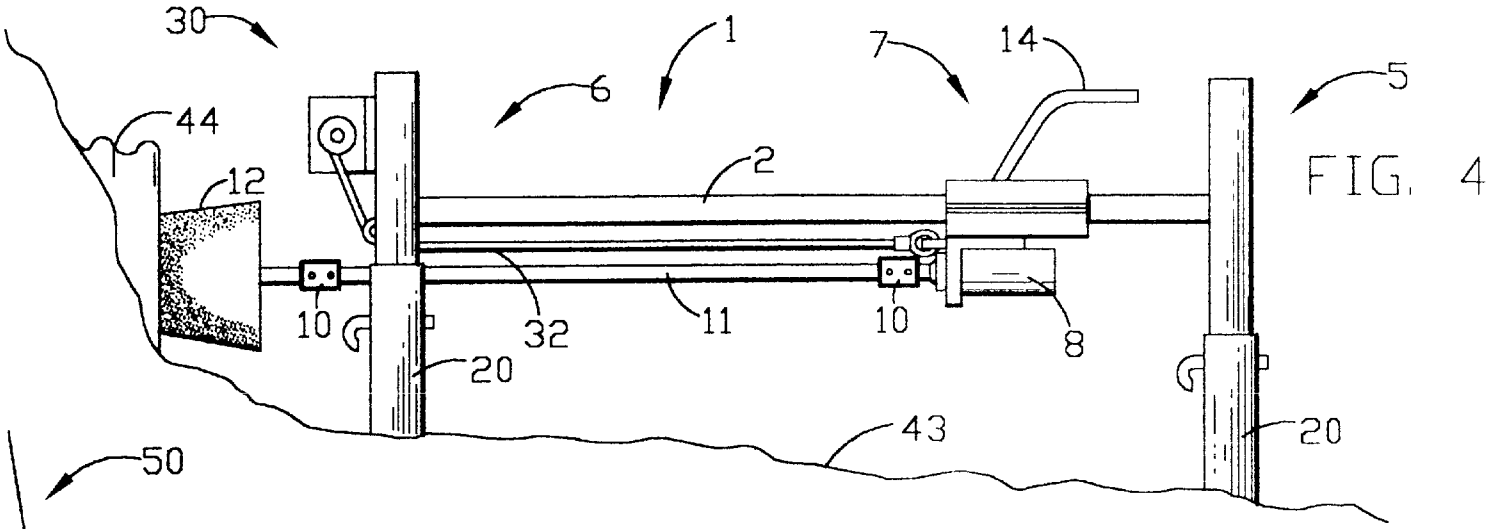
FIG. 4 is a side elevational view of the apparatus and components of FIGS. 1–3 in position to clean a culvert.

In FIG. 4 apparatus 1 is shown to have a beam 2 of a relatively short length to adapt to the rate that terrain 43 slopes away from culvert 44. Adjustable legs 20 of transverse leg assemblies 5 and 6 are adjusted to align beam 2 to be parallel to the longitudinal axis of culvert 44. Carriage 7 is positioned near transverse leg assembly 5. First drive link 11 is coupled to rotatable shaft 9 of motor 8 by means of first coupling 10. Culvert cleaning tool 12 is coupled to first drive link 11 by means of second coupling 10.

In use, couplings 10 may be hinges or universal joints to permit culvert clearing tool 12 to rest on the bottom of a culvert as when apparatus 1 is employed as a scraper, pusher, or scrubber. Carriage 7 may be manipulated by hand to impart a ramming or scraping or scrubbing action to tool 12 and motor 8 may be engaged so as to rotate culvert clearing tool 12 while carriage 7 is translated along beam 2 manually. Alternatively carriage 7 may be provided with a power assist such as that illustrated in FIG. 4. Winch 30 acting on cable 32 serves to draw carriage 7 along beam 2.

Figure 5:
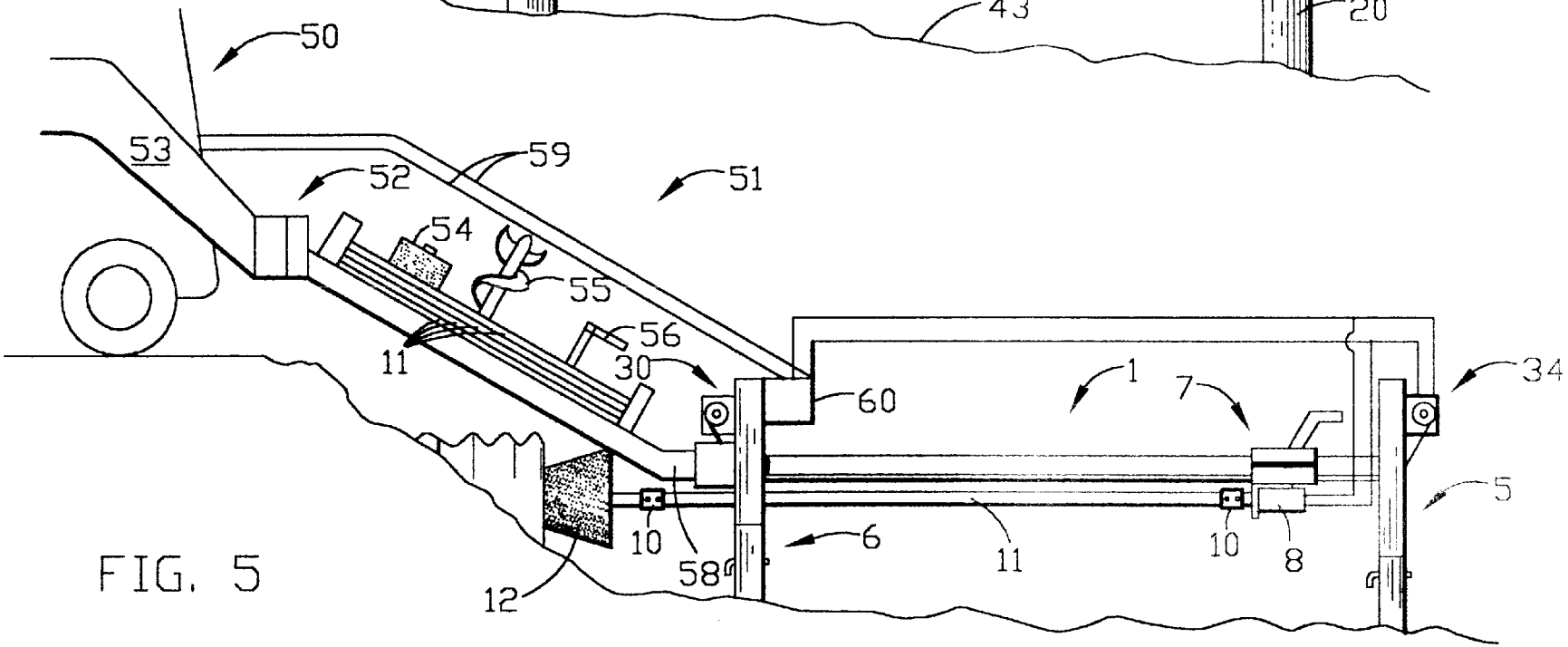
FIG. 5 is a side elevational view of a preferred embodiment of the apparatus of this invention showing the apparatus associated with a carrier vehicle, and carrier adaptor for joining the carrier vehicle to the apparatus.

Referring now to FIG. 5 wherein a preferred embodiment of the invention is shown wherein apparatus 1 is joined with a carrier vehicle 50 by employing a carrier adapter 51. When used as a general utility culvert cleaning apparatus, apparatus 1 would be moved from culvert to culvert in a local area and then adjusted to accommodate to the specific situation found with a specific culvert. This mode of operation is facilitated by the use of a carrier vehicle 50 such as a skid steerer as illustrated in FIG. 5. A carrier adaptor such as adaptor 51 is secured to the tilt mechanisms 52 of the bucket arms 53 of vehicle 50 and serves to permit the carrier vehicle to place apparatus 51 in position in alignment with a culvert while the carrier vehicle remains on the raised and usually level surface above the culvert. An operator then aligns apparatus 1 by adjusting transverse leg assemblies 5 and 6 so that beam 2 is positioned for cleaning the culvert. A culvert cleaning tool such as tool 12 or one of tools 54–56 is secured to a coupling 10 of drive link 11 and apparatus 1 is configured to clear the culvert.

Because of the variety of obstructions and deposits found in culverts, a variety of clearing and cleaning tools are needed. Carrier adaptor 51 serves to carry a variety of clearing and cleaning tools such as brushes 12 and 54, cutting tool 55 and scraper 56. Carrier adaptor 51 also serves as a carrier for extra drive links 11, couplings 10 and the like to make them readily at hand for an operator of apparatus 1.

Carrier adaptor 51 is joined to apparatus 1 by means of carrier arms 58 being inserted into receivers 31 of transverse leg assembly 6.

In FIG. 5, apparatus 1 is shown to have motor 8, which serves to rotate tool 12 and winches 30 and 34, which serve to translate carriage 7. These components require utilities to provide them power. Carrier adaptor 51 serves as a means for coupling utility lines 59 here shown schematically, between carrier vehicle 50 and apparatus 1. The utilities that may be provided from carrier vehicle 50 include electrical power, hydraulic power, pneumatic power, water under pressure and other utilities that enhance the versatility of culvert clearing apparatus 1. An operator standing near a control box 60 is in a position to observe the culvert clearing operation and to make the needed equipment changes as they become necessary.

The above disclosures are enabling and would permit one skilled in the art to make and use the disclosed invention for its intended purposes. However, due to the diversity of culverts and their environs, it should be understood that the scope of this invention includes the capacity to replace a component with an analogous component that is better suited for use in a specific application. Therefore the scope of this invention should not be limited by the scope of the embodiments disclosed and that the scope of the invention should only be limited by the appended claims and all equivalents thereto that would be made apparent to one skilled in the art.

What is claimed is:

1. An apparatus for cleaning culverts comprising;

a) a longitudinal beam having a first end and a second end, b) adjustable support legs secured to said first and second ends of the beam, c) a carriage mounted on the beam between the support legs, d) a means for moving the carriage along the beam, e) a motor having a rotatable shaft secured to the carriage beneath the beam, f) a means for coupling the motor to a drive link, g) at least one drive link having two ends and each end is configured to engage with a coupling, and one end of the drive link is coupled to the motor, and h) a culvert cleaning tool having a shaft and said shaft is configured to engage with a coupling and the shaft is engaged with a coupling at one end of the drive link.

2. The apparatus of claim 1 wherein the carriage is provided with a bearing formed of a high density, high lubricity plastic and a handle for manually translating the carriage along the beam.

3. The apparatus of claim 1 wherein the carriage is provided with a powered assist for translating the carriage along the beam.

4. The apparatus of claim 3 wherein the powered assist is provided with power from a carrier vehicle.

5. The apparatus of claim 4 wherein the apparatus is joined to the carrier vehicle by means of a carrier adaptor wherein the carrier adaptor is releasably connected to the carrier vehicle and releasably connected to the apparatus.

6. The apparatus of claim 5 wherein the carrier adaptor is releasably connected to the bucket tilt mechanism of a skid steerer and the carrier adaptor is releasably connected to the apparatus by means of carrier arms of the carrier adaptor being releasably engaged with receivers for the carrier arms secured to the apparatus.

7. The apparatus of claim 5 wherein the power for the powered components of the apparatus is supplied to the apparatus by means of power lines from the carrier vehicle connecting with power distribution means mounted on the apparatus.

8. The apparatus of claim 5 wherein the carrier adaptor is configured to carry tools, links, and couplings for use in a culvert clearing operation.

9. An apparatus for cleaning culverts comprising; a longitudinal beam having a first end and a second end, adjustable support legs secured to said first and second ends of the beam, a carriage mounted on the beam between the support legs, a means for moving the carriage along the beam, a motor having a rotatable shaft secured to the carriage beneath the beam, a means for coupling the motor to a drive link, at least one drive link having two ends and each end is configured to engage with a coupling and the drive link is coupled at one end to the motor, a culvert cleaning tool having a shaft and said shaft is configured to engage with a coupling and the shaft is coupled to one end of the drive link, and wherein;

a) the carriage is provided with a bearing formed of high density, high lubricity plastic and a handle for manually translating the carriage along the beam, b) the carriage is provided with a powered assist for translating the carriage along the beam, c) the apparatus is joined to a carrier vehicle by means of a carrier adaptor wherein the carrier adaptor is releasably connected to the carrier vehicle and releasably connected to the apparatus, and d) the power for the powered components of the apparatus is supplied to the apparatus by means of power lines from the carrier vehicle connecting with power distribution means mounted on the apparatus.

* * * * *